US007374516B2

(12) United States Patent
Lundquist

(10) Patent No.: US 7,374,516 B2
(45) Date of Patent: May 20, 2008

(54) WEIGHT LIFTING POWER CAGE WITH SLAVE RACK

(75) Inventor: Randal L. Lundquist, Mansfield, OH (US)

(73) Assignee: Recreation Supply, Inc., Sunbury, OH (US)

( * ) Notice: Subject to any disclaimer, the term of this patent is extended or adjusted under 35 U.S.C. 154(b) by 0 days.

(21) Appl. No.: 11/208,230

(22) Filed: Aug. 19, 2005

(65) Prior Publication Data

US 2007/0042876 A1 Feb. 22, 2007

(51) Int. Cl.
*A63B 21/078* (2006.01)
*A63B 21/072* (2006.01)

(52) U.S. Cl. ..... 482/104; 482/106; 482/135

(58) Field of Classification Search ..... 482/92–94, 482/98, 104, 106, 107, 135, 138; D21/673, D21/675, 679, 681, 686
See application file for complete search history.

(56) References Cited

U.S. PATENT DOCUMENTS

| | | | | |
|---|---|---|---|---|
| 4,795,149 | A * | 1/1989 | Pearson | 482/98 |
| 4,836,535 | A * | 6/1989 | Pearson | 482/101 |
| 5,050,868 | A * | 9/1991 | Pearson | 482/94 |
| 5,215,510 | A * | 6/1993 | Baran | 482/104 |
| 5,669,859 | A * | 9/1997 | Liggett et al. | 482/94 |
| 6,685,601 | B1 * | 2/2004 | Knapp | 482/104 |
| 6,811,521 | B1 * | 11/2004 | Musso | 482/104 |
| 7,131,937 | B2 * | 11/2006 | Skilken et al. | 482/93 |
| 2002/0091043 | A1 * | 7/2002 | Rexach | 482/98 |
| 2005/0054493 | A1 * | 3/2005 | Skilken et al. | 482/94 |
| 2007/0203002 | A1 * | 8/2007 | Webber | 482/104 |

FOREIGN PATENT DOCUMENTS

| | | | |
|---|---|---|---|
| GB | 2364928 | A * | 2/2002 |
| WO | WO 200124886 | A1 * | 4/2001 |
| WO | WO 2005030341 | A1 * | 4/2005 |

* cited by examiner

*Primary Examiner*—Loan H. Thanh
*Assistant Examiner*—Victor K. Hwang
(74) *Attorney, Agent, or Firm*—Mueller Smith

(57) ABSTRACT

A weight lifting power cage for use by a weight lifter includes a frame assembly including a pair of side frames and a rear lateral frame interconnecting the pair of side frames. A carriage is carried by the side frames and is movable simultaneously vertically and front to back. The carriage retains a weight bar mount for retaining a weight bar spanning between each side frame. The weight bar is movable by the carriage vertically and front to back. The movable carriage also carries a pair of vertical weight rack bars. An engagement mechanism enables the weight lifter to rack the weight bar from a weight lifting position without stepping forward or backward.

9 Claims, 5 Drawing Sheets

WEIGHT LIFTING POWER CAGE WITH SLAVE RACK

CROSS-REFERENCE TO RELATED APPLICATIONS

None

STATEMENT REGARDING FEDERALLY SPONSORED RESEARCH

Not applicable.

BACKGROUND OF THE INVENTION

The present invention generally relates to weight lifting cages for free weights and more particularly to a weight lifting cage having a movable carriage with slave racking capability.

Safety is always a concern to weight lifters, especially as the amount of weight approaches and passes the body weight of the weight lifter. Even lesser amounts of weight can be dangerous if the lifter loses control of the weight bar. For that reason, a spotter often is employed to assist the lifter should the amount of weight being lifted prove uncontrollable or should the lifter lose his/her balance while lifting weights. Often, however, a spotter is unavailable to the lifter and other safety means need to be employed.

One such other safety means is a weight lifting apparatus, often referred to as a power rack or power cage, such as is described in U.S. Pat. No. 5,215,510 or in U.S. Pat. No. 5,669,859. Such power cages are designed for the lifter to lift free weights without the need for a spotter. Power cages generally include a pair of side frames interconnected by a back frame. Each side frame carries a carriage, movable front to back and up and down. A weight bar runs laterally and is carried by the movable carriage. The lifter can add any desired amount of free weights to the weight bar and stand within the cage. The lifter can lift the bar while being able to step slightly forward and slightly backward within the cage, while simultaneously lifting the weight bar up and down. The dual-movable carriage permits such dual movement.

In one power cage model (see U.S. Pat. No. 5,669,859), each vertical side bar of the front and back frames have a series of outwardly projecting pins while the weight bar carriage has outwardly projecting hooks. The lifter can move to the front or to the back of the power cage and rack the weight bar by engaging the hooks onto the pins.

While this safety feature was a welcome addition to the weight lifting art, it still requires the lifter to move forward or backward to the cage frames in order to rack the weight bar. In an emergency, the lifter may not have sufficient time to walk to the frame periphery to rack the weight bar. The present invention is addressed to improving the ability of the lifter to rack the weight without stepping forward or backward.

BRIEF SUMMARY OF THE INVENTION

A weight lifting power cage for use by a weight lifter includes a frame assembly, a carriage, weight rack bars, and an engagement mechanism. The frame assembly includes a pair of side frames and a rear lateral frame interconnecting the pair of side frames. A carriage is carried by the side frames and is movable simultaneously vertically and front to back, i.e., depthenally. The carriage also carries a weight bar mount for retaining a weight bar spanning between each side frame. The weight bar is movable by the carriage vertically and depthenally, i.e., front to back. The movable carriage also carries a pair of vertical weight rack bars. An engagement mechanism enables the weight lifter to rack the weight bar from a weight lifting position without stepping forward or backward by dint of the rack bars also being mounted on the movable carriage.

Advantages of the present invention include a weight lifting power cage, which permits simultaneous vertical and depthenal movement of the lifter during lifting. Another advantage is the ability of the lifter to rack the weight bar without stepping forward to backward from the weight lifting position. These and other advantages will be readily apparent to those skilled in the art based on the disclosure set forth herein.

BRIEF DESCRIPTION OF THE DRAWINGS

For a fuller understanding of the nature and advantages of the present invention, reference should be had to the following detailed description taken in connection with the accompanying drawings, in which.

The drawings will be described in further detail below.

DETAILED DESCRIPTION OF THE INVENTION

Definitional terms appropriate for the present invention include:

- "weight lifting power cage" or "power cage" means a frame assembly retaining a weight bar, upon which free weights can be secured, such as are disclosed in U.S. Pat. Nos. 5,215,510 and 5,669,859.
- "rack" means to place a weight bar, barbell, or other weight lifting assembly to a stationary or home position.
- "vertical" means both upwardly and downwardly in a generally vertical direction.
- "lateral" means side to side.
- "depthenally" means front to back, back to front, or forwardly and rearwardly.
- "weight bar" means a generally horizontal bar, often made of metal, upon which weights, often called "free weights", can be secured for a weight lifter or lifter to perform a series of repetitive movements of the weight bar as part of an exercise program or regimen, most often associated with body builders.

Figure 1:
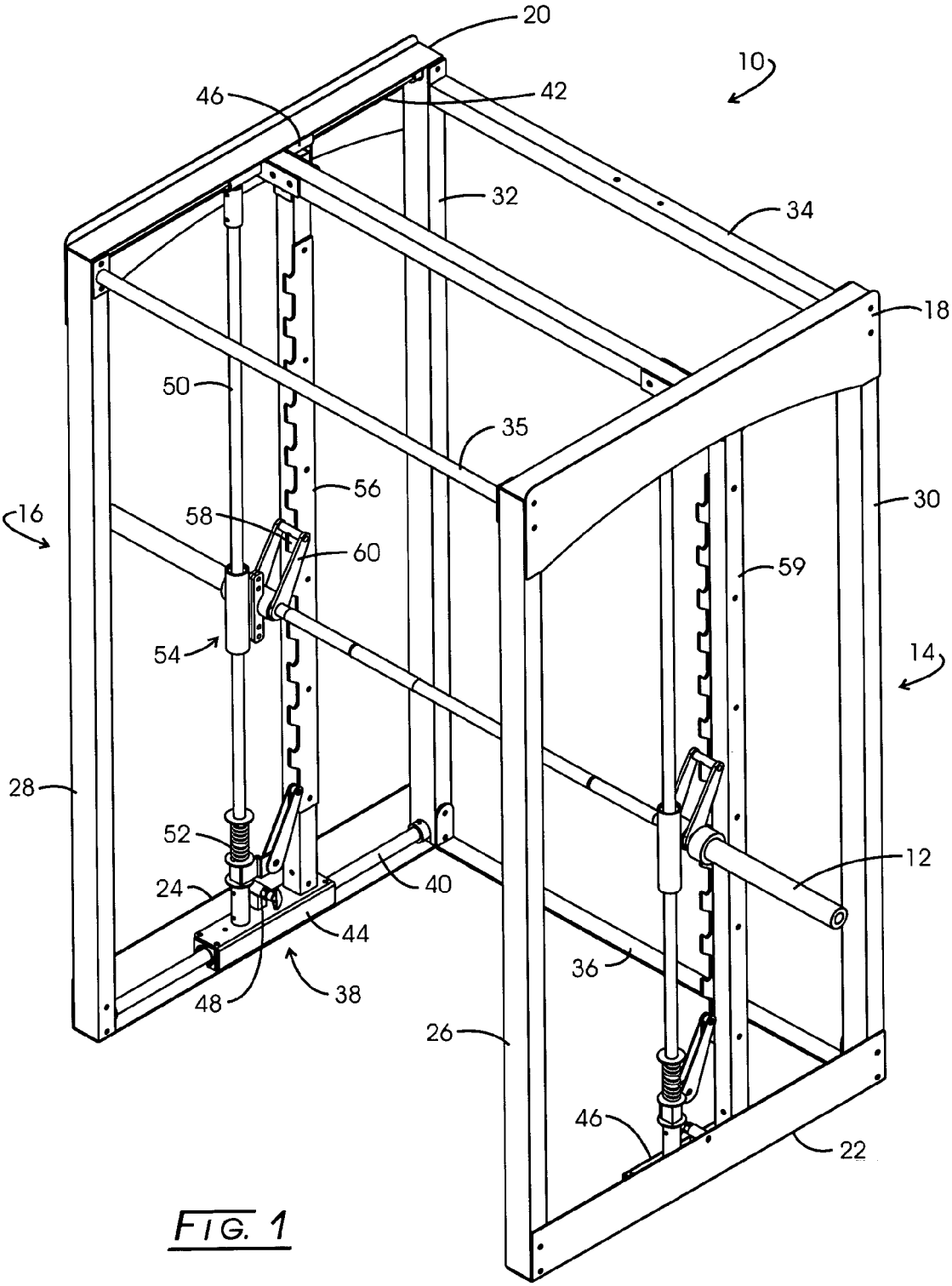
FIG. 1 is a perspective view of the weight lifting power cage.
Figure 4:
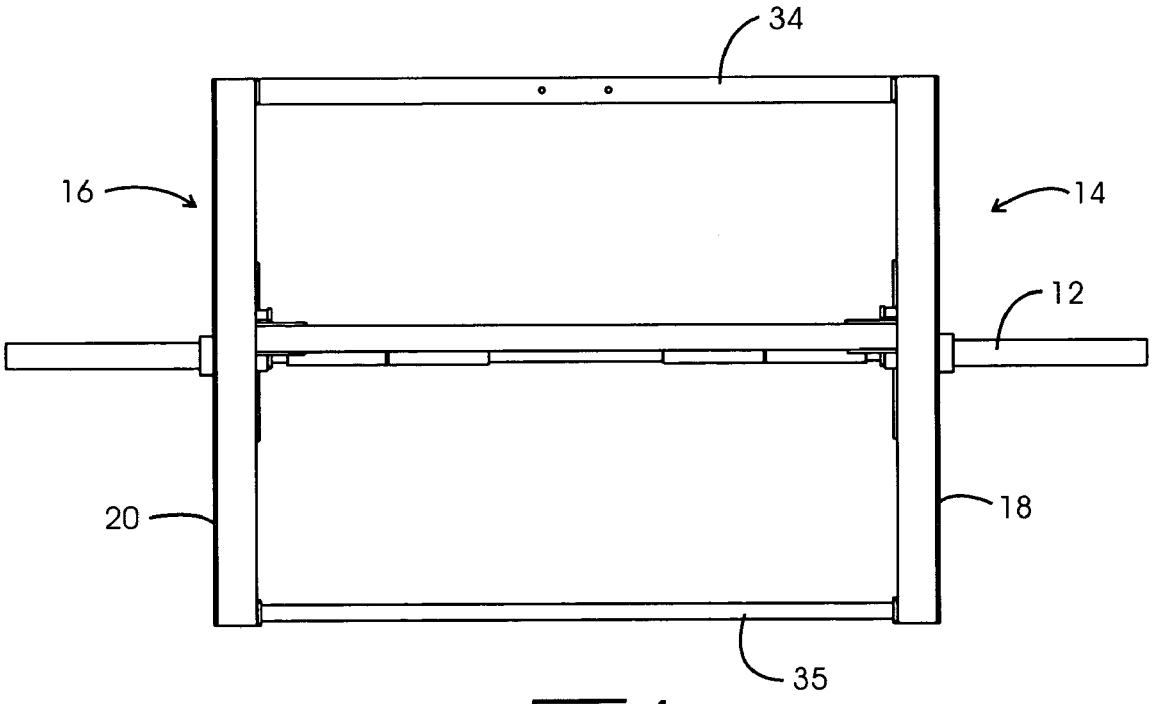
FIG. 4 is an overhead view of the weight lifting power cage of FIG. 1.
Figure 5:
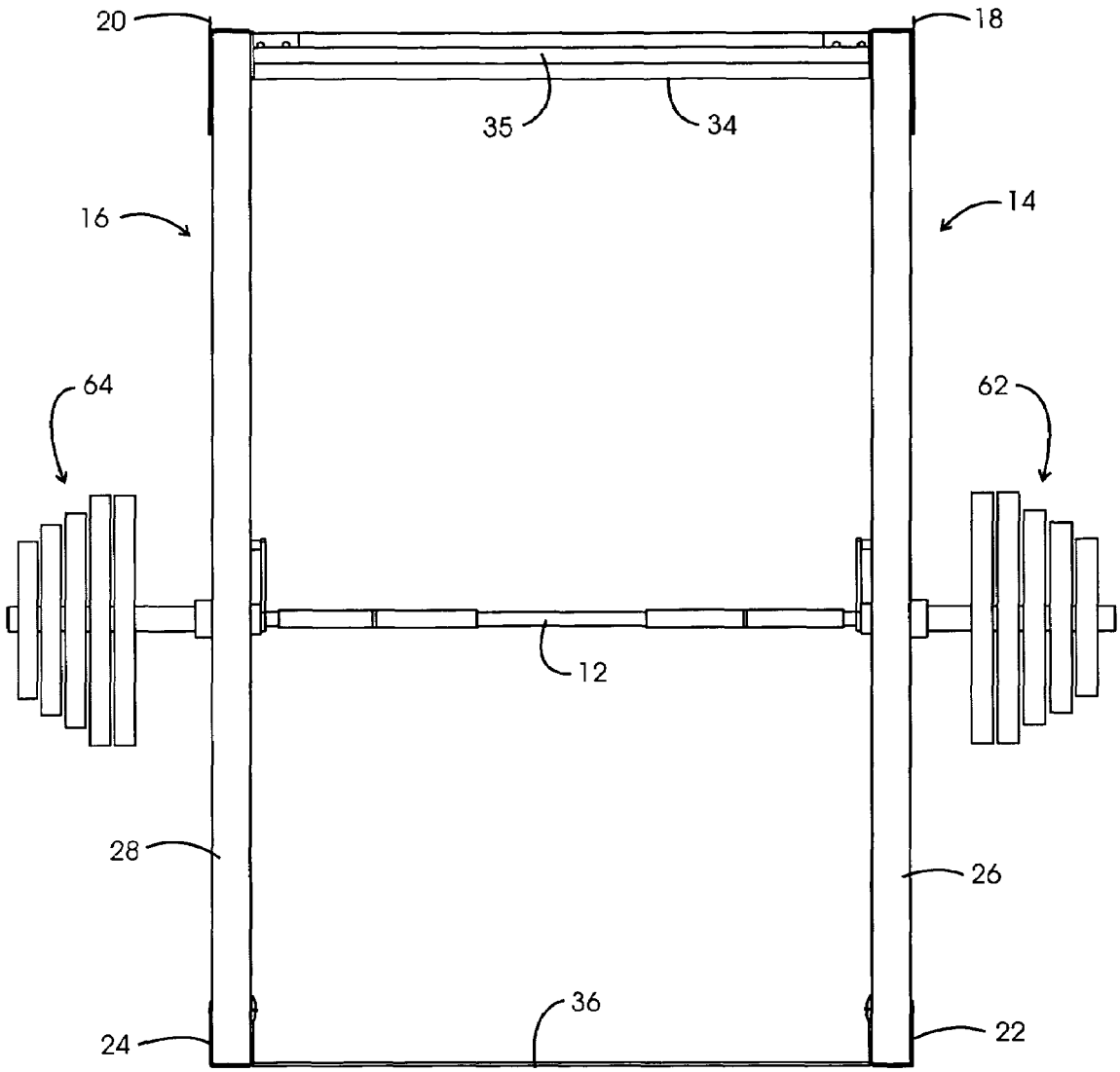
FIG. 5 is a front elevational view of the weight lifting power cage of FIG. 1 with weights placed on the weight bar.

Referring initially to FIG. 1, a weight lifting power cage, 10, is shown for retaining a weight bar, 12, which can carry free weights, 62 and 64, as illustrated in FIG. 5. Power cage 10 is formed from a pair of spaced-apart side frame assemblies, 14 and 16. Each side frame assembly includes an upper depthenal frame member, 18 and 20; a lower depthenal frame member, 22 and 24; a pair of forward vertical frame members, 26 and 28; and a pair of rearward vertical frame members, 30 and 32. The side frame assembly 14 and 16 and joined by an upper lateral member, 34, and a lower lateral member, 36, and in the front by an upper lateral member, 35 (see FIG. 4 also). The respective frame members can be affixed together to form frame assemblies 14 and 16 by a variety of techniques, such as, for example, bolts, welds, rivets, screws, or any similar joining technique. The precise joining technique is unimportant, so long as requisite rigidity and strength are achieved for the intended weight lifting purposes of the inventive power cage. Also, such frame members often are formed from metal for strength and durability; although, other materials of construction are possible. Other than using nylon or other friction-reducing materials where appropriate, the entire power cage typically is constructed from metal, i.e., primarily constructed from metal.

Each frame assembly 14 and 16 carries a carriage assembly that supports weight bar 12. Since each carriage assembly is the same, only carriage assembly, 38, carried by frame assembly 16 will be described in detail. Running along with upper and lower side rails 20 and 24 of frame assembly 16 are a lower slide bar, 40, and an upper slide bar, 42. Each of these bars 40 and 42 carry a guide sleeve, 44 and 46, respectively, movable depthenally along the extent of slide bars 40 and 42, and including linear bearings, rollers, or similar mechanisms. Guide sleeve 44 carries a stop pin, 48, which can be engaged to prevent guide sleeve 44 from moving along the extent of slide bar 40 whereby the inventive power cage becomes a traditional "Smith" or fixed power cage mechanism.

Figure 3:
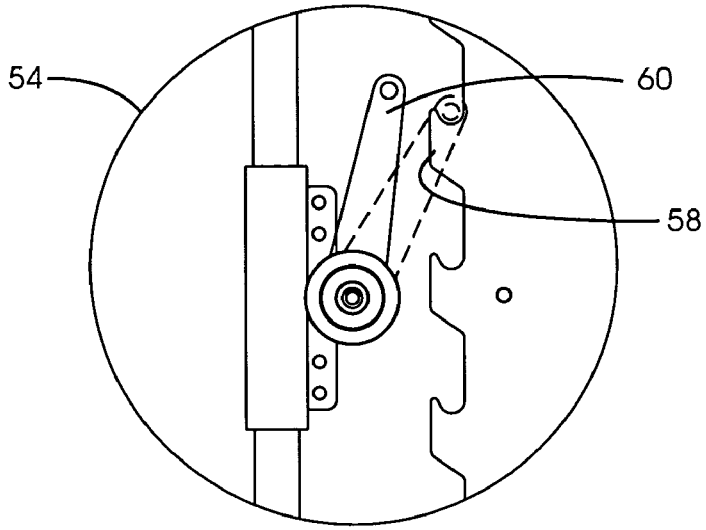
FIG. 3 is an enlarged view of racking latch circled in FIG. 2.

A vertical slide bar, 50, extends between lower guide sleeve 44 and upper guide sleeve 46. Vertical slide bar 50 retains a spring assembly, 52, about its lower end. Spring assembly 52 protects the lifter and guide sleeve 44 should weight bar 12 be inadvertently dropped. Vertical slide bar 50 also carries a weight bar slide assembly, 54 (see also FIG. 3), which can slide along with vertical extend of vertical slide bar 50. Weight bar slide assembly 54 in turn carries weight bar 12.

Guide sleeves 44 and 46 also retain therebetween a vertical rack bar, 56, which as a series of projecting rack pins, such as, for example, rack pin 58. Now, weight bar 12 carries a latch assembly, 60, which is rotatable about weight bar 12 and matable with rack pin 58, as well as the other rack pins carried by vertical rack bar 56. Latch assembly 60 is shown as a U-shaped assembly; although, a variety of shapes are operable. The same is true of the rack pins, which can be formed in a variety of shapes. So long as latch assembly 60 can be caught and retained by rack pin 58, the desired racking purpose is achieved. That is, should the lifter desire to cease lifting weight bar 12, the lifter need only move weight bar 12 slightly to the rear of the lifter and engage the rack pins with the latch assemblies to rack weight bar 12. The lifter can accomplish racking simply by rotating or flipping the wrists slightly backwards, either under normal or emergency (imminent loss of control of weight bar 12) conditions, to rack weight bar 12.

Figure 6:
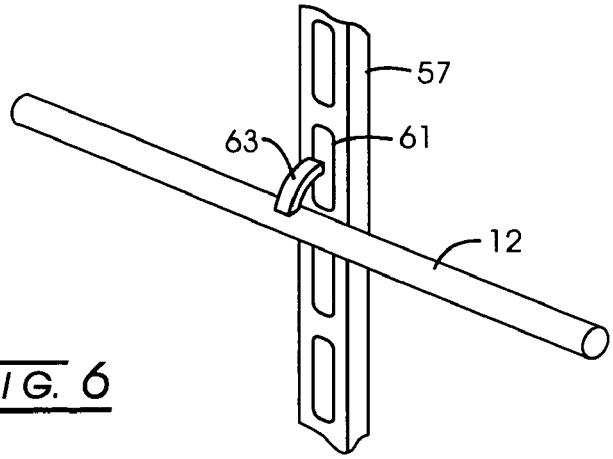
FIG. 6 is an exploded view of an alternative engagement mechanism for racking the weight bar.

Latch assembly 60 is one suitable engagement mechanism for racking weight bar 12. Another suitable engagement mechanism is shown in FIG. 6 and consists of vertical slots, such as vertical slot 61 in vertical rack bar 57, which can be coupled with a hook, 63, carried by weight bar 12. Again, the weight lifter can simple rotate the wrists slightly backwards for hook 63 to fit into slot 61 and, thus, rack weight bar 12. It will be appreciated that a multiplicity of such slots are formed in vertical rack bars 56 and 57. So, too, does weight bar 12 carry a hook that mates with the vertical slots formed into vertical rack bar 59. The skilled artisan can envision additional engagement mechanisms based on the disclosure set forth herein.

Figure 2:
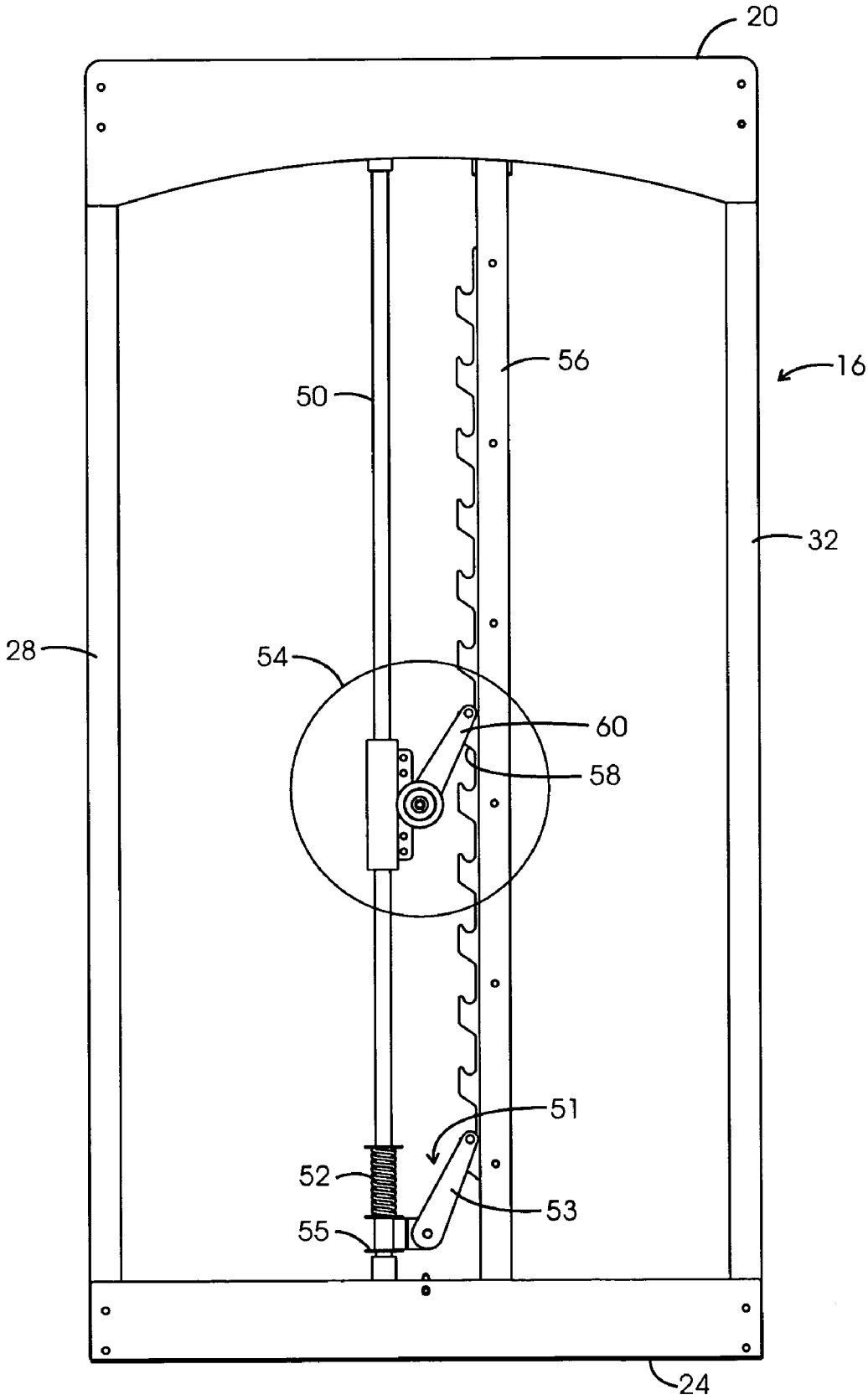
FIG. 2 is a side elevational view of the weight lifting power cage of FIG. 1.

Referring to FIG. 2, an adjustable/movable safety spotter, 52, can be moved up and down vertical slide bar 50 by a position assembly, 51, formed by a latch, 53, engagable by the rack pins and a fraction stop assembly, 55. By squeezing friction stop assembly 55 together slightly, it can be moved up and down vertical slide bar 50 carrying latch 53 with it. At any desired vertical position, the lifter can engage a rack tooth carried by vertical rack bar 56 to lock spring assembly 52 into any desired position. A similar safety spotter also is associated with the other vertical slide bar.

Guide sleeve 44 enables the lifter to stand in almost any location within power cage 10 and even to move forward and backward as the lifter lifts weight bar 12. Since vertical rack bar 56 also is carried by guide sleeve 44, the lifter can rack weight bar 12 also at almost any location within power cage 10.

Figure 7:
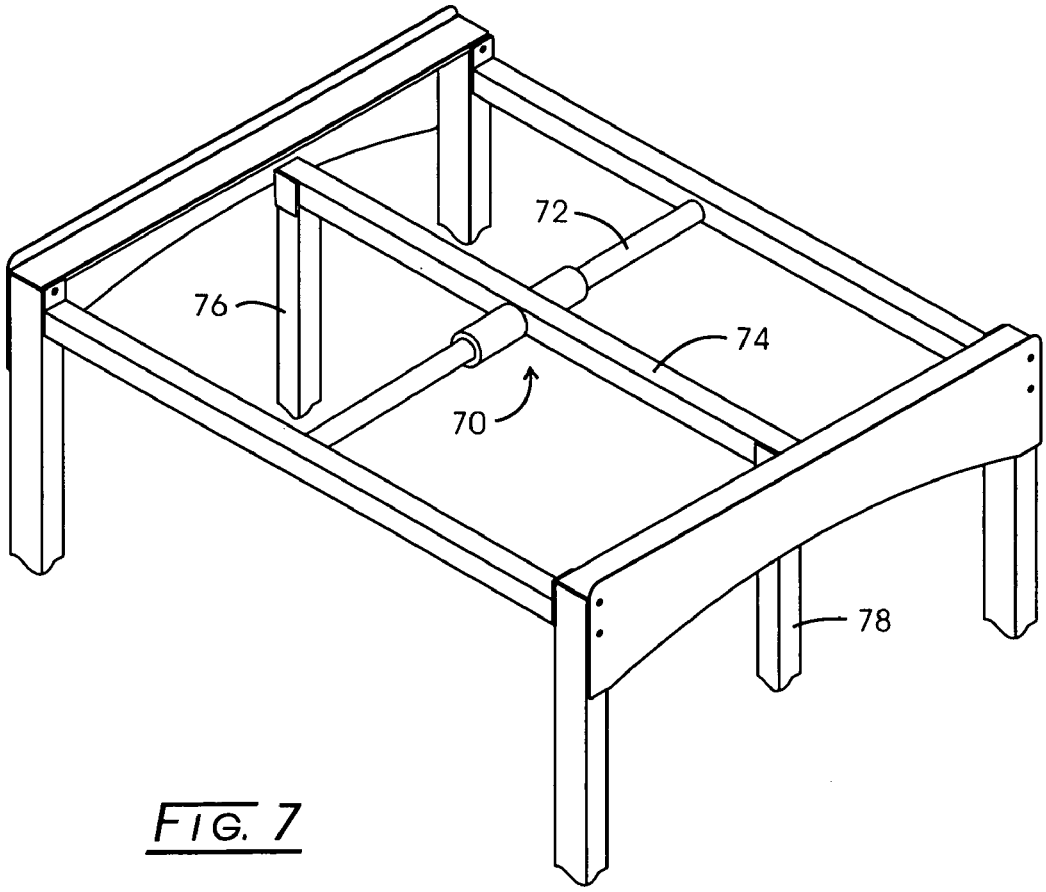
FIG. 7 is a partial view of the power cage having an alternative upper carriage assembly.

While a variety of variations on the inventive power cage are within grasp of the skilled artisan, one such variation, for example, is depicted in FIG. 7. The upper portion of the power cage has been adapted to function with but a single upper carriage assembly, 70, mating a depthenal slide bar, 72, and a side slide bar, 74, joined at either end to a pair of vertical slide bars, 76 and 78. Carriage assembly 70 can move depthenally along slide bar 72 and laterally along slide bar 74. Again, this is but another variation on the inventive power cage disclosed herein.

While the invention has been described with reference to a preferred embodiment, those skilled in the art will understand that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims. In this application all units are in the metric system and all amounts and percentages are by weight, unless otherwise expressly indicated. Also, all citations referred herein are expressly incorporated herein by reference.

I claim:

1. A weight lifting power cage for use by a weight lifter, which comprises:

(a) a frame assembly including a pair of spaced-apart side frames, each said side frame including an upper depthenal frame member, a lower depthenal frame member and a forward vertical frame member, and a rearward vertical frame member, and a rear lateral frame including an upper lateral member and a lower lateral member which rear lateral frame interconnecting said pair of side frames; and (b) a carriage assembly carried by said side frames and movable front to back relative to and between said forward and rearward vertical members during lifting by a weight lifter, said carriage having:

(i) a weight bar spanning between each side frame, (ii) a pair of spaced-apart vertical slide bars which remain vertical as the carriage assembly moves front to back, (iii) a pair of weight bar mount assemblies, each slidably mounted to a said vertical slide bar, said weight bar mount assemblies affixed to said weight bar for vertical movement of said weight bar along said vertical slide bars, (iv) a pair of vertical weight rack bars carried by said movable carriage and located in spaced-apart adjacency from said weight bar, (v) an engagement mechanism carried by said weight bar and engagable with said weight rack bars, said engagement mechanism activated by the weight lifter rotating said weight bar to rack said weight bar from a weight lifting position without the carriage, moving forward or backward, said weight bar movable vertically and front to back, and said weight bar and weight rack bars movable together front to back.

2. The weight lifting power cage of claim 1, wherein said pair of vertical weight rack bars carries outward projecting pins and said weight bar carries a latch assembly, matable with said pins for racking said weight bar.

3. The weight lifting power cage of claim 1, wherein said vertical weight rack bars have slots, said weight bar has a pair of hooks aligned with said weight rack bar slots, wherein said hooks fit into said weight rack bar slots for racking said weight bar.

4. The weight lifting power cage of claim 1, wherein said carriage assembly comprises:

a pair of slide bars carried by each said side frame end disposed along the bottom and the top of said frames; and a guide sleeve slidably mounted on said slide bars and carrying said vertical weight rack bars.

5. The weight lifting power cage of claim 1, wherein said carriage assemblies also carries stop pins selectively engagable to prevent movement of said carriage assemblies.

6. The weight lifting power cage of claim 1, wherein said weight bar retains a pair of latch assemblies engagable with said vertical weight rack bars to restrict the vertical movement of said weight bar.

7. The weight lifting power cage of claim 1, wherein said weight bar retains weights about both ends thereof.

8. The weight lifting power cage of claim 1, which is fabricated primarily of metal.

9. A weight lifting power cage having a top and for use by a weight lifter, which comprises:

(a) a frame assembly including a pair of side frames and a rear lateral frame interconnecting said pair of side frames; and (b) a carriage assembly carried by said side frames and movable front to back during lifting by a weight lifter, said carriage having;

(i) a weight bar spanning between each side frame, said weight bar movable vertically and front to back;

(ii) a pair of spaced-apart vertical slide bars;

(iii) a pair of weight bar mount assemblies, each slidably mounted to a said vertical slide bar, said weight bar mount assemblies affixed to said weight bar for vertical movement of said weight bar along said vertical slide bars, (iv) a pair of vertical weight rack bars carried by said movable carriage and located in spaced-apart adjacency from said weight bar, said weight bar and weight rack bars movable together front to back;

(v) an engagement mechanism carried by said weight bar and engageable with said weight rack bars, said engagement mechanism activated by the weight lifter to rack said weight bar from a weight lifting position without the carriage moving forward or backward;

(c) a pair of bottom slide bars carried by said side frames and disposed along the bottom of said side frames;

(d) a slide bar mounted centrally about the top of said power cage and carrying a guide sleeve, said guide sleeve connected to said vertical weight rack bars; and (e) a guide sleeve slidably mounted on said bottom slide bars and carrying said vertical weight rack bars.

* * * * *